US005323660A

United States Patent [19]

Wirtz et al.

[11] Patent Number: 5,323,660

[45] Date of Patent: Jun. 28, 1994

[54] APPARATUS FOR CLASSIFYING TEXTILE TUBES ACCORDING TO THE AMOUNT OF YARN THEREON

[75] Inventors: Ulrich Wirtz; Wolfgang Irmen, both of Monchen-Gladbach, Fed. Rep. of Germany

[73] Assignee: W. Schlafhorst AG & Co., Moenchengladbach, Fed. Rep. of Germany

[21] Appl. No.: 862,359

[22] Filed: Apr. 2, 1992

[30] Foreign Application Priority Data

Apr. 2, 1991 [DE] Fed. Rep. of Germany ..... 4110626

[51] Int. Cl.[5] ..... G01M 19/00

[52] U.S. Cl. ..... 73/865.8

[58] Field of Search ..... 73/865.8, 149, 159, 73/160; 33/501.02, 501.04, 503, 504, 556, 549, 558, 559, 732, 733; 242/129.5, 129.51, 129.6; 19/0.23; 209/601, 604, 605

[56] References Cited

U.S. PATENT DOCUMENTS 3,368,283 2/1968 Le Vasseur ..... 33/556

4,158,919 6/1979 McMurtry ..... 33/556

*Primary Examiner*—Tom Noland

*Assistant Examiner*—Daniel S. Larkin

*Attorney, Agent, or Firm*—Shefte, Pinckney & Sawyer

[57] ABSTRACT

The present invention provides an apparatus for use in classifying yarn package carrying tubes according to the amount of yarn, if any, thereon. The classifying apparatus includes a device for detecting the presence of yarn on a tube beyond a predetermined radial spacing from the axis of the tube. A device axially moves the detecting device relative to the tube during yarn detecting operation. A signal providing device is operatively connected to the detecting device for providing a signal in response to the commencement, the cessation, or the absence of detection of yarn by the detecting device. The signal providing device can also provide a signal to indicate both the commencement and the cessation of yarn detection. A device determines the axial location of the detecting device relative to the tube. Based upon information regarding the axial location of the detecting device at the time that a signal is provided indicating the commencement, the cessation, or the absence of detection of yarn, the extent of the yarn, if any, remaining on a tube can be calculated.

19 Claims, 7 Drawing Sheets

APPARATUS FOR CLASSIFYING TEXTILE TUBES ACCORDING TO THE AMOUNT OF YARN THEREON

BACKGROUND OF THE INVENTION

The present invention relates to an apparatus for classifying textile tubes according to the amount of yarn thereon as well as according to the absence of yarn thereon.

In the normal situation, the tubes are unwound until completely empty at the winding stations of a winding machine; that is, they leave the winding station as empty tubes. However, it can happen that a variably large winding remnant may remain, in which the yarn end can no longer be brought to the applicable yarn guide devices or to a yarn splicer within the winding station. As a rule, empty tubes ejected from the winding station, tubes with a small remnant and tubes with a larger, reusable winding remnant are all removed together. Since these bobbins have to be handled differently, detectors that can recognize these different winding states and can control their routing to various transport paths must be used along the common return path.

German Published Patent Application DE-AS 12 78 308 shows an apparatus in which, first, bobbins with a relatively large winding remnant, and then bobbins with a winding remnant that can no longer be reused, are separated from the common return belt. Empty tubes are returned directly to the spinning machine.

While the winding thickness that is still present is detected at the first fork along the path via the deflection of a mechanical scanner, a photooptical detector that is capable of detecting small remaining winding amounts is disposed at the second fork.

German Patent Disclosure Document DE 36 03 002 A1 describes a transport system between a spinning and a winding machine, in which the tubes are mounted on independent carriers. The empty tubes arriving from a common return belt, tubes with a small winding remnant, and tubes with a larger winding remnant are likewise differentiated at a bobbin stripper station. A photoelectric sensor, comprising a light source and a photo sensor, is disposed so as to be located outside the cross section of the tube. Hence the photoelectric sensor is interrupted only if a relatively large winding diameter is present. If so, then this tube is carried onward and returned to the winding machine. If the photoelectric sensor is not interrupted, the tube stripper apparatus becomes operative and pulls the empty tube or the tube with a small winding remnant off the mandrel of the individual carrier vertically. A brush-like feeler is in contact with the outer circumferential face of the empty bobbin and can be rotated by means of a shaft. If the bobbin is pulled off upward and if some remaining yarn is present, this remaining yarn enters into engagement with the feeler, causing the feeler to rotate. This rotation of the feeler is detected by a sensor, which triggers a shunt associated with the stripper device and thereby sorts out empty tubes from tubes having a small yarn remnant.

Known systems thus have separate devices for distinguishing between larger and smaller winding remnants, as well as between empty bobbins and bobbins with a small winding remnant. However, the need still exists for an apparatus which can reliably classify bobbins or yarn packages in a wide variety of classifications according to the amount of yarn, if any, thereon.

SUMMARY OF THE INVENTION

Briefly described, the present invention provides an apparatus for use in classifying yarn package carrying tubes according to the amount of yarn, if any, thereon. The apparatus includes means for detecting the presence of yarn on a tube beyond a predetermined radial spacing from the axis of the tube and means for axially moving the tube and the detecting means relative to one another during yarn detecting by the detecting means. Also, the classifying apparatus includes means for providing a signal in response to at least a selected one of the commencement, the cessation, and the absence of detection of yarn by the detecting means within a predetermined range of relative axial movement between the tube and the detecting means and means for determining the axial location of the detecting means and the tube relative to one another.

According to one aspect of the present invention, the detecting means includes means for engaging yarn on the tube, the engaging means being movable between a first position out of yarn engagement and a displaced position displaced from the first position in response to the engaging means engaging yarn on the tube. Also, the classifying apparatus also includes means for automatically returning the engaging means from its displaced position to its first position in response to movement of the engaging means out of engagement with yarn on the tube, and the signal means includes means for providing a signal in response to return movement of the engaging means from its displaced position to its first position.

According to another aspect of the present invention, each tube is of the type on which yarn is built in a body of yarn having an axial extent less than the axial extent of the tube such that at least one exposed end of the tube is not covered by the body of yarn and the means for axially moving the tube and the detecting means relative to one another includes means for axially displacing the detecting means from a start position at which the detecting means is positioned adjacent an exposed end of a tube to at least a signal location at which the means for providing a signal provides a signal and the determining means includes means for determining the extent of axial movement of the detecting means between the start position and the detecting position.

According to one feature of the another aspect of the present invention, the classifying apparatus also includes means for resiliently biasing the engaging means radially toward a tube to be detected, the resiliently biasing means permitting radially shifting the engaging means relative to a tube in response to changes in the radial extent of the yarn being engaged by the engaging means to thereby minimize the axial forces exerted on the yarn of a tube by the engaging means moving axially therealong. Preferably, there is also provided a housing for pivotally mounting the engaging means for pivoting thereof between its first and displaced positions about a pivot axis transverse to the axis of a tube being detected.

According to a different aspect of the present invention, the engaging means includes a serrated edge having apices, the engaging means being supported for raking movement along the yarn of a tube being detected.

According to a further feature of the another aspect of the present invention, the means for providing a signal includes a magnet mounted to the engaging means for movement therewith and means for generating a signal in response to the proximity of the magnet thereto within a predetermined distance range, whereby the magnet is displaced from a position proximate the signal generating means to a more remote position in correspondence with movement of the engaging means from its first to its displaced position and the signal generating means generates a signal in response to movement of the magnet into its more proximate position.

According to yet another aspect of the present invention, the classifying apparatus includes means for adjustably setting the first position of the engaging means.

According to an additional feature of the another aspect of the present invention, the engaging means includes a plate member and a lever arm having one end pivotally mounted for pivoting about the pivot axis and another end mounted to the plate member for revolving movement of the plate member about the pivot axis, the means for resiliently biasing the engaging means includes a contact surface disposed for movement radially intermediate the pivot axis and the tube being detected and the radial location of the pivot axis is selected such that one end of the plate member, which extends radially inwardly of the contact surface for engaging yarn on the tube, extends radially inwardly to its greatest extent in the first position of the engaging means. According to a further additional feature of the another aspect of the present invention, the engaging means includes a plate member and a lever arm having one end pivotally mounted for pivoting about the pivot axis and another end mounted to the plate member for revolving movement of the plate member about the pivot axis.

According to one detail of the additional feature of the another aspect of the present invention, the portion of the means for resiliently biasing the engaging means which forms the contact surface terminates in the axial direction at a location axially spaced from the pivot axis for permitting unrestricted movement of the plate member radially inwardly and outwardly of the contact plate during pivoting of the plate member. According to another detail, the one end of the plate member is disposed for engaging yarn on the tube terminates in a surface portion extending at a less acute angle to the axis of the tube than the adjacent surface portion for relatively smooth engagement of the yarn. According to a further detail, the engaging means includes a sheath plate extending adjacent the plate member for engaging yarn on the tube extending radially outwardly of the yarn engaged by the plate member to facilitate radially outward shifting of the engaging means during travel of the plate member along yarn of increasing radial extent.

According to yet another additional aspect of the present invention, the means for axially displacing the detecting means includes a pair of rollers, an endless belt trained around the pair of rollers, and means for driving the endless belt, the detecting means being mounted to the endless belt for movement therewith. According to one detail of the yet another additional aspect of the present invention, the determining means includes means for counting the number of revolutions of one of the rollers and means for determining the extent of axial movement of the detecting means as a function of the number of revolutions of the one roller. According to another detail, the classifying apparatus also includes means for biasing the engaging means radially toward the tube and means for adjustably setting the radially inwardmost position of the engaging means.

DETAILED DESCRIPTION OF THE PREFERRED EMBODIMENTS

Figure 1:
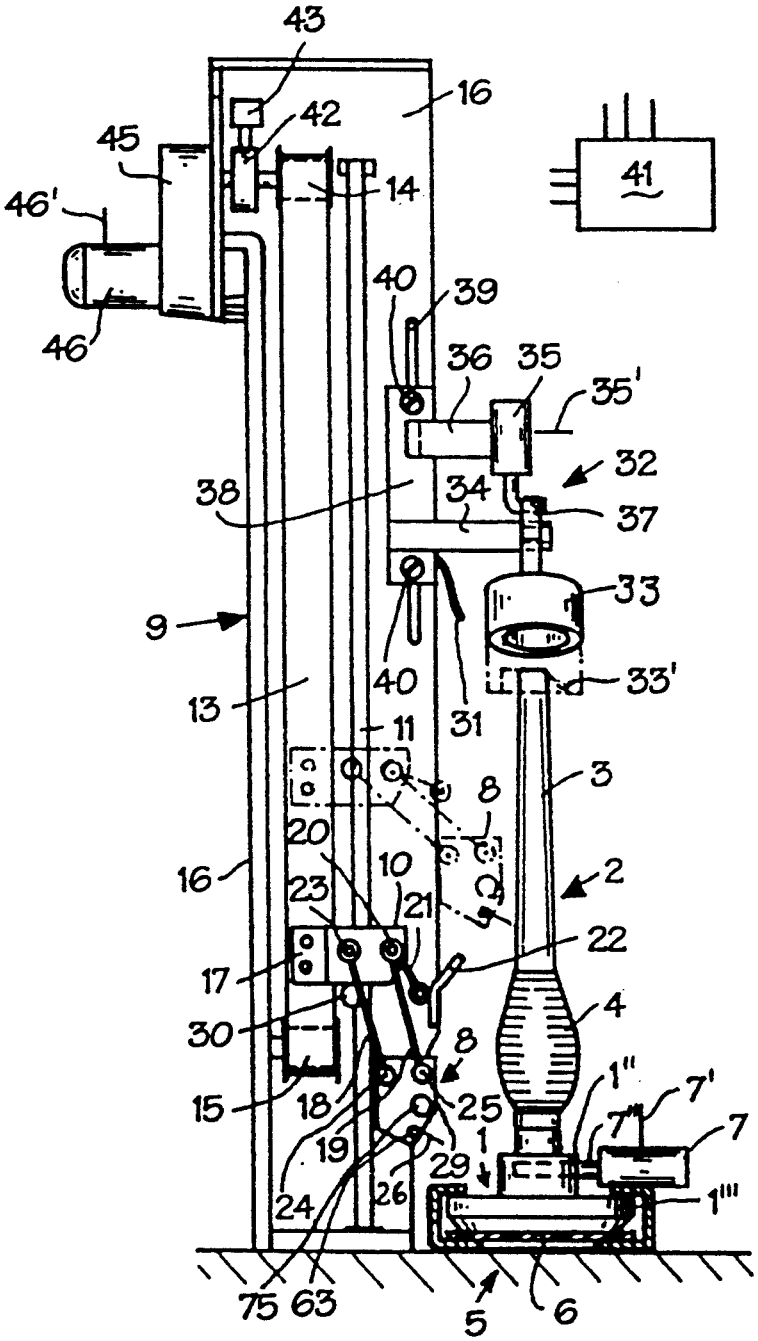
FIG. 1 is a side elevational view of one embodiment of the classifying apparatus according to the invention.
Figure 2:
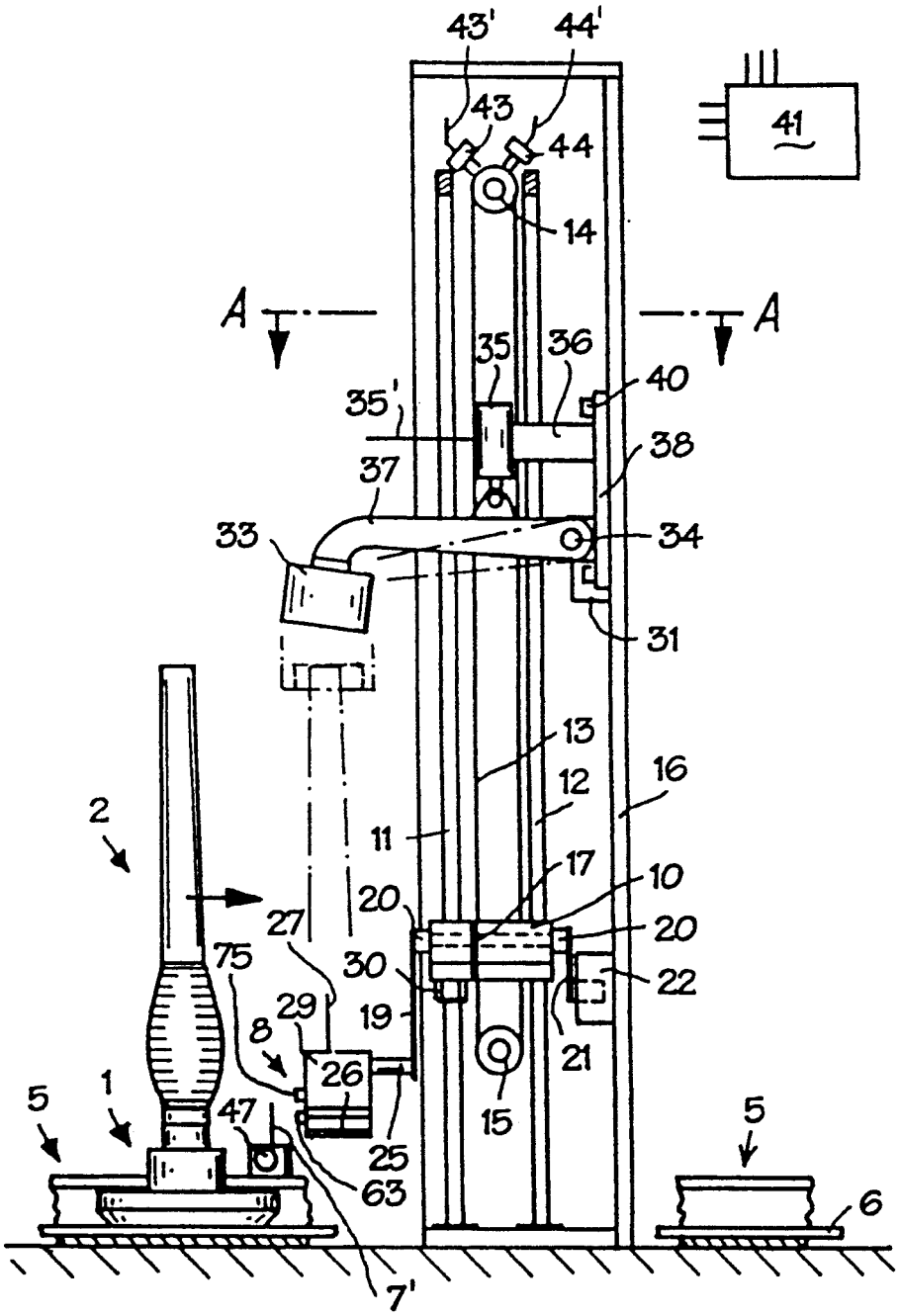
FIG. 2 is a front elevational view of the apparatus shown in FIG. 1.

In FIGS. 1–6, one embodiment of the classifying apparatus of the present invention is illustrated and is operable to be supplied with these tubes from a conveyor belt 6 along a transport channel 5. The tubes are placed for transport on mutually independent caddies 1, which are carried along by the conveyor belt 6 by frictional engagement. The transport channel 5 serves to guide the caddies 1.

The classifying apparatus includes means for detecting the presence of yarn on a tube beyond a predetermined radial spacing relative to the axis of the tube, or scanner head, 8. For stopping a given caddy 1 at the scanner, a stopper 7 is used, which is disposed at a level at which its gate 7″ stops the caddy 1 at its pedestal-like structure 1″ which is located above a base plate 1‴. This stopper 7 can be triggered either by a means for determining the axial location of the detecting means and the tube relative to one another, or central control unit, 41 assigned to the scanner or by a sensor 47, disposed upstream of the transport channel 5, via a control line 7″.

Stopping the caddies 1 at their pedestal-like structure 1″ has the advantage that if there is a backup of caddies, then because of the base plates 1‴ there is enough space between the pedestal-like structures 1″ of adjacent caddies to slide the gate 7″ of the stopper 7, which was retracted in order to release a caddy 1 carrying a tested bobbin 2, back into the transport path before it contacts the next caddy 1. The actuating mechanism for the gate 7″ in which case a fluid cylinder, can as already mentioned also protrude past some of the base plates of the caddies 1; this makes it possible to shorten the necessary reciprocating travel of the gate 7″.

The scanner head 8 is pivotably connected to a lifting device 9 having a lifting carriage 10 via parallel steering arms 18 and 19. The lifting carriage 10 is disposed longitudinally displaceably in guide rails 11 and 12. It is connected via a mounting 17 to a lifting belt 13, by which it can be displaced along the guide rails 11 and 12.

The endless lifting belt 13 is guided by two deflection rollers 14 and 15. The deflection roller 14 is connected to a motor 46 via a gear 45. It accordingly acts as a drive roller for the lifting belt 13.

A field spider 42, which has magnet poles separate from one another on its plate member, or periphery, 60, for example, is disposed on the shaft connecting the deflection roller 14 to the gear 45. These magnet poles are scanned in contactless fashion by two Hall sensors 43 and 44, which communicate with the central control unit 41 via signal lines 43' and 44'. The pulses furnished by the two Hall sensors 43 and 44 are counted in the central control unit 41. The counter outcome at a given time characterizes the position of the lifting belt 13 and thus of the lifting carriage 10 and scanner head 8.

The use of two Hall sensors 43 and 44 is necessary only if the danger exists that some manual intervention may be done that would change the position of the lifting carriage 10. Since the disposition of the Hall sensors is done such that one Hall sensors is aimed directly at one magnet pole of the field spider 42 while the other Hall sensor is located directly between two magnet poles, it is possible not only to count the increments but also to detect the direction of motion of the lifting belt 13. As a result, after a manual intervention, the apparatus can be returned automatically to the starting position. However, if one wishes to omit this safety feature, one Hall sensor is basically adequate.

In principle, however, it should be assumed that two Hall sensors, with the same field spider spacing, achieve twice the accuracy in travel measurement, if as described the second Hall sensor is disposed offset from the other by half of that spacing.

A parking brake should be disposed in the gear or directly on the motor 46, to prevent an unintended change in the position of the lifting carriage 10 by its own weight.

A device for centering, or orienting, the bobbin 2 to be tested is provided on a stand 16, orienting it in such a way that the surface of the tube 3 of the bobbin 2 toward the scanner head 8 is oriented vertically. In each case, care must be taken that the scanner head 8, along its reciprocation path, is at a uniform distance from the tube 3.

This means for aligning a bobbin to be detected in an alignment generally parallel to the path of movement of the detecting means, or centering device, 32 has a centering head 33, whose profile toward the tip of the applicable tube 3 is embodied in cone-like fashion, but the side 33' of the cone remote from the scanner is flatter. As a result, the tube 3 is pivoted out of its vertical orientation toward the scanner head by an angle that corresponds to its conicity.

Instead of this provision, however, it is also possible to incline the means for axially moving the tube and the detecting means relative to one another, or lifting device, 9, in particular guide rails 11 and 12, or the entire stand 16 by an order of magnitude that corresponds to the conicity of the applicable tubes 3. In any case, the possibility of making a reliable determination of the winding state even with relatively slight conicity of the tubes 3 always exists, if the scanner is moved parallel to the longitudinal axis of the tubes. Care must merely be taken that the scanner itself have contact with the tube 3 wherever a full tube has its winding.

If the procedure is in accordance with the first method described, it may prove necessary, in the event of-a relatively pronounced conicity of the tubes, for the transport channel to have a recess, not shown, on its underside so that the caddy 1, which then participates in the tilting motion, will not jam the conveyor belt 6.

Both the mounting 34 itself and a further mounting 36 for the fluid cylinder 35 are secured to a carrier 38. This carrier 38 is mounted via stop screws 40 in an oblong slot 39 of the stand 16. This type of mounting is necessary to enable adapting the centering device 32 to various tube lengths.

Via a piston 35' that is pivotably connected to the pivot arm 37 for the centering head 33, the centering device is actuated by the fluid cylinder 35. To release, a given bobbin 2, the pivot arm 37 must be pivoted upward until a new bobbin is positioned at the stopper 7. To this end, the fluid cylinder 35 is connected to the central control unit 41 via a control line 35'. The central control unit 41 controls this fluid cylinder 35 either in a timed manner or as a function of signals of the sensor 47, for example, which to that end would have to be connected to the central control unit 41. It is equally conceivable to provide a proximity sensor directly at the testing position. To that end, the caddies 1 each have an iron ring, not shown here, on the circumference of their base plate 1'''. Using such caddies also has the further advantage that they can be controlled in the direction of motion with the aid of electromagnets, for instance.

The two extreme values for the position of the scanner head 8 can be inputting into the central control unit 41; normally, bottom dead center of the scanner is fixed, because regardless of the tube length, the tube base and thus the lower edge of the winding are disposed at a height that stays the same. This lower position of the scanner head 8 can accordingly also serve to calibrate the counting device in the central control unit 41. A buffer 30 disposed on the guide rail 11 may be provided as a lower stop for the lifting carriage and may simultaneously serve as a sensor, for example a proximity sensor, and set the counting mechanism to zero. It is also conceivable, for example, to provide an identifying marker on the lifting belt that can be detected by a sensor, disposed at the proper height, when the lowermost position of the lifting carriage 10 is reached. Via the control line 46' the motor 46 can be triggered by the central control unit 41 such that it reduces its rpm as it approaches the bottom dead center position of the lifting carriage 10, so that the dead center position is accurately reached and overly hard braking can be avoided.

The suspension of the scanner head 8 from the pair of parallel steering arms 18, 19 will now be described in further detail. As can be seen from FIG. 4, the parallel steering arm 19 is secured on a shaft 20 that extends through the lifting carriage and has a lever 21 with a scanning roller 21' on one end. Upon approaching bottom dead center, this scanning roller 21' runs up against a runup contour 22 that is secured to the stand 16. As a result, the lever 21 and with it, via the shaft 20, the parallel steering arm 19, and with it the scanner head 8 in turn, are all pivoted backward. The pair of parallel steering arms 18, 19 assures that the spatial orientation of the scanner head 8 will not change as a result. However, as will be described in further detail hereinafter, this is especially significant while the bobbin surface is being scanned. The pivoting in the lower position is necessary if the dead center is located such that a means for engaging yarn on the tube, or the scanner, 26 can itself come into contact with parts of the caddy 1. It remains possible for the scanner head 8 to be put in its upper position required for the testing, once the tested bobbin has left the testing station. If in that case the scanner head 8 were not pivoted away from the bobbin, then the scanner 26 would have to absorb a lateral force during transport of the bobbin, and this would shorten its service life. On the other hand, if the bottom dead center of the scanner head 8 is located such that the scanner 26 does not yet reach the pedestal-like structure 1'' of the caddy 1 and if the return stroke occurs still while the bobbin is in the testing station, then it is unnecessary to provide for pivoting the scanner head out of the way.

The scanner head 8 also includes means for resiliently biasing the engaging means radially toward a bobbin to be detected, the resiliently biasing means permitting radially shifting the engaging means relative to a bobbin in response to changes in the radial extent of the yarn being engaged by the engaging means, or support face, 29.

Analogously to the runup contour 22, a further runup contour 31 may be provided in the region of top dead center of the lifting carriage 10; it effects pivoting away of the scanner head 8 at top dead center as well. This runup contour 31 assures that the scanner head 8 or the scanner 26 will not come into contact with the tube 3 until the place where the winding can begin. This point may also be adjusted farther downward, however, if the operator has no need to differentiate the winding within the upper third of the tube, for example. On the other hand, if measurement must be done quite far upward as well, then it may also be necessary to flatten the centering head 33 on the side toward the scanner head, in order to avoid contact between the support face 29 of the scanner head 8 and the centering head. In principle, this is no problem, either, because the centering head is intended above all to tilt the tube 2 onto the scanner head, and the side of the centering head toward the scanner head basically has no function.

Figures 4, 6:
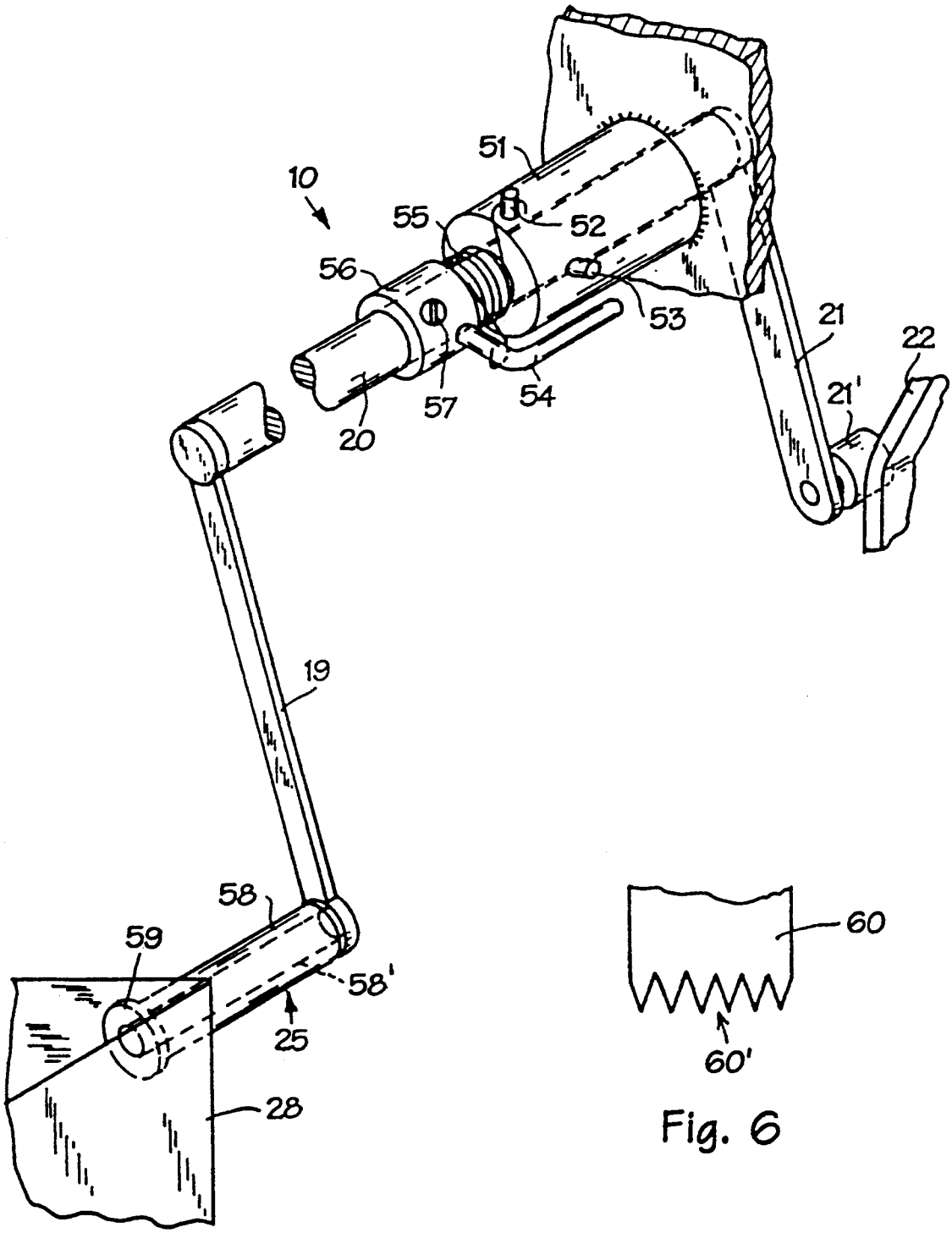
FIG. 4 is an enlarged perspective view of the mounting arrangement for mounting the detecting means to the axial moving means of the embodiment of the classifying apparatus shown in FIG. 1.
FIG. 6 is an enlarged top elevational view of a portion of the plate member of the engaging means of the classifying apparatus shown in FIG. 1.

The illustration in FIG. 4 also shows that the shaft 20 connecting the parallel steering arm 19 .and the lever 21 is controlled in its motion. A means for biasing the engaging means radially toward the tube, or torsion spring, 55, which is supported against a cam 52 secured to a bush 51, is suspended from a 90° offset stop bolt 54 of a mounting 56. This mounting 56 is connected to the shaft 20 via a set screw 57. The torsion spring 55 accordingly causes rotation of the shaft 20 counterclockwise, as viewed from the left. A means for adjustably setting the radially inwardmost position of the engaging means, or cam, 53 that is likewise secured to the bush 51 serves as a stop for the 90° offset stop bolt 54. Since the bush 51 is firmly joined to the lifting carriage 10, the position of the cam 53 within the lifting carriage is fixed. This stop therefore forms a limitation for the horizontal motion, aimed at the tube, of the scanner head 8. As a result, the scanner head always occupies the same forwardmost position along its reciprocating travel, and accordingly the same conditions prevail in the testing of each bobbin. For example, if tubes having a different diameter are used after a conversion to a different batch of yarn, this front stop can easily be adjusted, after the set screw 57 has been loosened, by rotating the mounting 56 relative to the shaft 20.

The parallel steering arm 19 is connected to the scanner head 8, in the manner also shown in FIG. 4. By means of a fixed connection 59, for example a welded or soldered connection, a busing 58 is secured to the housing for pivotally mounting the engaging means for pivoting thereof between its first and displaced positions about a pivot axis transverse to the axis of a tube being detected, or a housing, 28, and a shaft 58' secured to the parallel steering arm 19 protrudes into this bushing; together, the bushing and the shaft form the pivot joint 25. By way of example, the shaft 58' is secured by a snap ring, not shown here, in the bushing 58.

Figure 3:
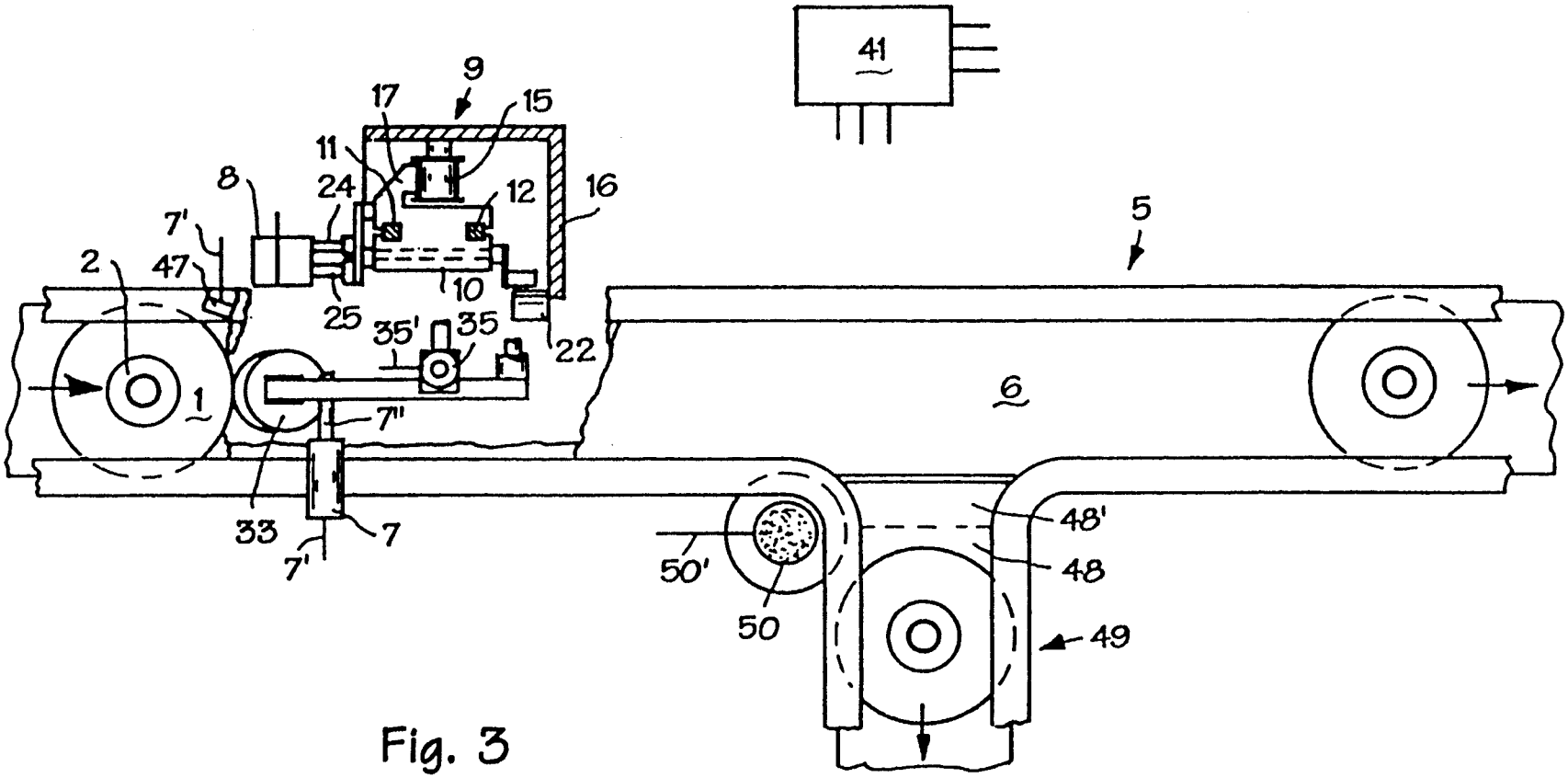
FIG. 3 is a top plan view, in partial horizontal section, taken along lines A—A of FIG. 2, showing the transport path of the tubes to and from the classifying apparatus of the present invention.

FIG. 3 shows that a fork in a transport channel 49 is disposed downstream of the classifying apparatus. A conveyor belt 48 runs within this transport channel 49 and is deflected by a deflection roller 48' and a further deflection roller (not shown). A shunt comprising an electromagnet 50 is disposed at this fork and is triggered via a control line 50' by the central control unit 41 as a function of the scanner outcome, or in other words as a function of the winding state of the bobbin 2. Another fork may be disposed on the transport channel 49 or facing the transport channel 49. As a result, empty tubes can stay on the conveyor belt 6 and be delivered to the spinning machine, for instance, while tubes with a small winding remnant and tubes with a reusable winding remnant are carried along different routes. If there is another transport channel facing the transport channel 49, then once an empty tube has been detected neither the electromagnet 50 nor the electromagnet associated with the facing transport channel is activated. If a winding remnant is found, then depending on the winding quantity detected, one of the two electromagnets is turned on, and as a result the separation to different transport routes takes place. It is equally possible, as can be learned from German Patent Disclosure Document DE 40 09 318 A1, for the corresponding distribution of the tubes to be made along the transport channel 49 in accordance with the quantity of winding remnant on them.

Figure 5:
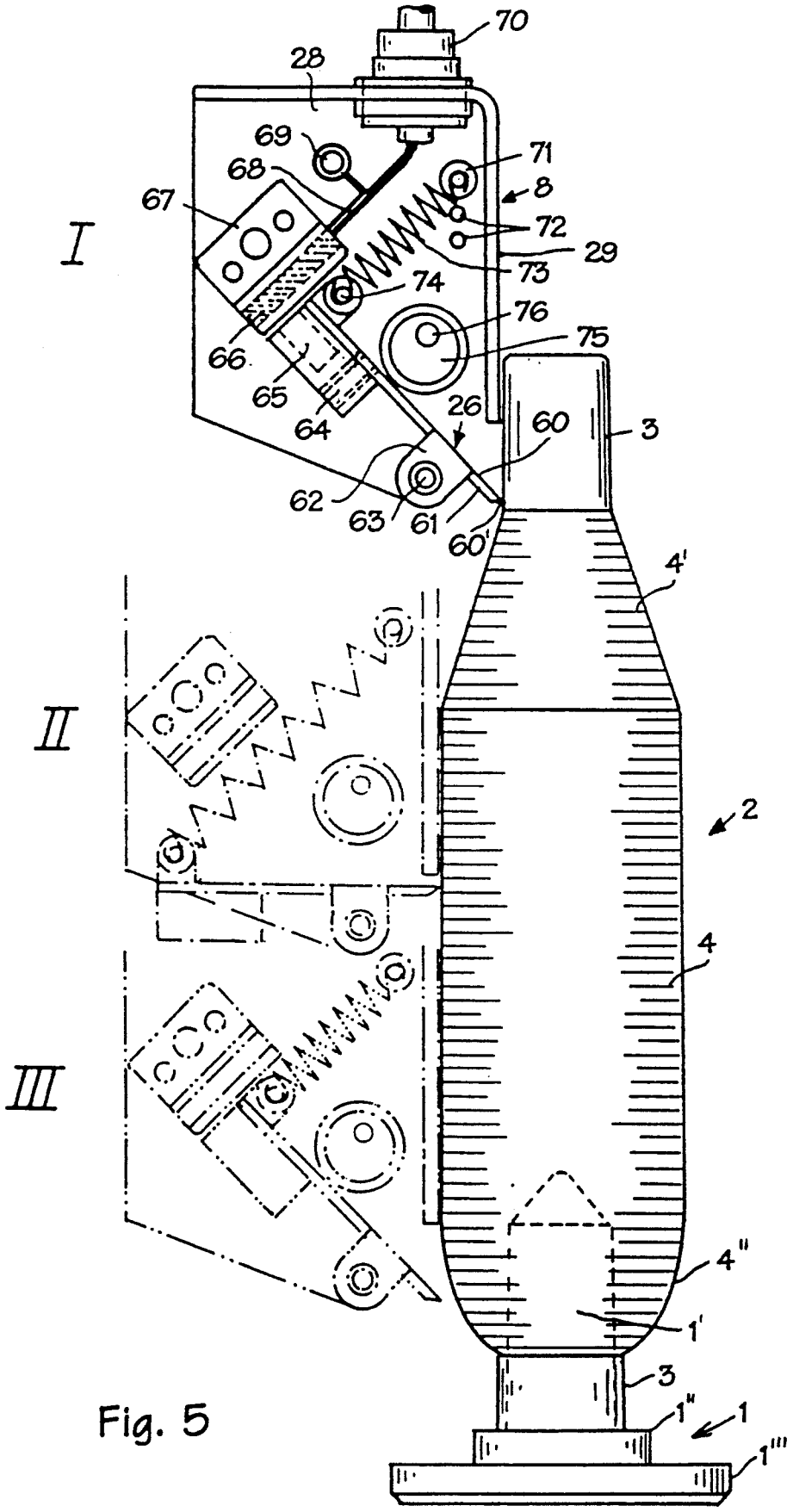
FIG. 5 is an enlarged side elevation view, in partial vertical section, of the detecting means of the classifying apparatus and showing, in broken lines, various positions of the detecting means relative to a tube being detected.

A typical scanning process will now be described, in conjunction with FIG. 5. A bobbin 2 with an existing winding 4 on a tube 3 is slipped onto the mandrel 1' of a caddy 1. This caddy also has a pedestal-like structure 1'' and a base plate 1''' which gives the caddy its stability and guides it along its transport paths. This scanner head 8 is shown in three phases, I–III, which represent the main phases in a testing cycle. The scanner head 8 in position I, which is shown in greater detail, will be described first.

A pivot shaft 63 for the scanner 26 is disposed in a housing 28. The scanner plate 60 is secured jointly with a support plate 61 to the mounting 62, which is rotatably supported on the pivot shaft 63. The scanner plate 60 has a surface portion extending at a less acute angle to the axis of the tube than the adjacent surface portion, or profiled front edge, 60' on the side of the scanner 26 toward the top 2. This edge may have teeth, for example, as shown in FIG. 6. It is equally possible to provide a needle comb instead of the teeth. A brush-like embodiment is also possible; in principle, the goal is to provide a good grip, so that as soon as the front edge 60' comes into contact with even one yarn or only a few yarns, the scanner will be pivoted in the scanning direction.

The scanner 26 has a mounting 64 for a damping magnet 65 on its other end. This mounting 64 is also provided with means for automatically returning the engaging means from its displaced position to its first position in response to movement of the engaging means out of engagement with yarn on the tube, or a spring fastener, 74 for a restoring spring 73. This restoring spring 73 is joined to the housing 28 at its other end via a spring fastener 71 which may be mounted in various bores 72 of the housing 28, and as a result the restoring force acting upon the scanner can be varied accordingly. A means for adjustably setting the first position of the engaging means, or eccentric, 75 on which the scanner 26 rests in its position of repose is likewise connected to the housing 28 of the scanner head 8, via an eccentric lock 76. The eccentric 75 is variable in its angular position via the eccentric lock 76, so that the contact point and hence the position of repose of the scanner 26 are also adjustable. In the position of repose of the scanner 26, the damping magnet 65 faces a means for providing a signal in response to at least a selected one of the commencement, the cessation, and the absence of detection of yarn by the detecting means within a predetermined range of relative axial movement between the tube and the detecting means, or proximity switch, 66. This condition is signaled by the proximity switch 66, via a line 68, to a connection bush 70, to which a cable, not shown and leading to the central control unit 41, can be connected by means of a cable plug. From the line 68, a fork also leads to a monitor lamp 69, enabling visual monitoring as to whether the proximity switch 66 is functional. The proximity switch 66 is secured to the housing 28 of the scanner head 8 via a mounting 67.

Upon the vertical displacement of the scanner head 8 out of the position I into the position II, the scanner is tilted counterclockwise. This is effected by the contact of the front edge 60' of the scanner plate 60 with the winding at the upper edge of the winding cone 4', so that the scanner plate can no longer slide over the otherwise smooth tube 3. The resistance at the beginning of the winding to the structured front edge 60' is greater than the tilting force of the scanner 26, brought about by the restoring spring 73, that is to be overcome. As seen in FIG. 6, the front edge of the support plate 61 is beveled, and as a result the scanner plate 60 can slide easily over the winding, particularly as it slides onto the winding cone 4', without damaging it.

As can be seen in position II, the scanner head 8 is substantially supported relative to the winding 4 by its support face 29, which is rounded on its front edge in order to protect the winding. Thus this support plate 29 bears virtually the entire supporting force of the scanner head 8, which is pivoted counter to the force of the torsion spring 55 (FIG. 4).

In this position of the scanner 26, the damping magnet 65 is remote from the proximity switch 66. This is signaled to the central control unit 41, which defines this signal as a detected yarn remnant. However, since at the same time the pulses transmitted by the Hall sensors 43 and 44 are counted and a travel signal is produced, a logic circuit provided in the central control unit 41 generates the appropriate information for evaluating the signal trains, that is, information as to the height of the tube 3 beyond which a winding 4 was found.

In position III, the front edge 60' of the scanner plate 60 has lost its contact with the winding, because of the conical tapering 4'' of the winding 4, after which the scanner 26 has been retracted to its position of repose against the eccentric 75 by the restoring spring 73 as a result of the fact that the support plate 29 still rests on the largest winding circumference at a time when the front edge 60' of the scanner plate 60 has already left the winding.

The signal generated at the proximity switch 66 is also supplied to the central control unit 41, which once again makes an association with the isochronous travel signal. Since the travel signal indicates that the bottom dead center of the lifting carriage 10 has not yet been reached, the information that a lower winding cone 4'' is present is obtained in this way. This information may be significant, for instance if the beginning of the winding was detected approximately in the middle of the tube.

In such cases in particular, it is possible that there may be only a few layers of yarn, yet they may extend up to that height of the tube 3. If the scanner head is moved along this kind of yarn remnant, then by the time it reaches its lowermost position the scanner will no longer pivot back, or will not pivot back until the scanner head has pivoted backward as a result of contact of the scanner roller 21' with the runup contour 22. However, that does not occur until at the soonest when the front edge 60' of the scanner plate 60 has reached a position at which the winding typically ends. Any pivoting backward combined with the travel signal generated in this position will no longer be recognized by the central control unit 41 as a reusable bobbin having sufficient yarn to make it worthwhile to further attempt to unwind the yarn therefrom. For this reason, the remaining yarn remnant is classified as only slight and thus as no longer reusable.

The embodiment of the scanner and in particular the disposition of the pivot shaft 63 are provided such that as much as possible, the front edge 60', between its two extreme positions, reaches its forwardmost position toward the tube in the middle of this region. This prevents the profiled front edge from sweeping over the winding with a strong pressing force. Instead, at the beginning of the winding the scanner is tilted as far as its position opposite the position of repose, and it is drawn over the winding in an already retracted position compared with that forwardmost position. As already shown, the beveling on the support plate 61 also makes for gentle handling of the winding.

Moreover, this position of the scanner is also relatively stable, so that as it moves over the winding the scanner undergoes hardly any oscillation, which might cause measurement errors.

The association of the applicable sensor signal with the associated travel signal furnishes an exact determination of the winding state of the particular bobbin. It is accordingly possibly not only to distinguish whether there is no winding on the tube or a small winding quantity or a larger winding quantity, but it can also be determined how large the winding remnant is. The winding machine operator can for instance arbitrarily fix the lower limit for such a winding remnant that he considers worth further unwinding. However, it would also be conceivable for example to provide this bobbin, on some information carrier assigned to it, with information on the winding amount still present. This information may for instance be used to deliver the bobbin to specific winding stations, if a reading device is disposed at a fork along the delivery path of the bobbins to the winding machine and if this reader triggers the applicable routing means, such as shunts. It would also be conceivable to evaluate the bobbin fullness information in the winding station, if a suitable reader is available there. The winding station computer could be triggered as a result and would then control the lowering of the winding speed at the proper time to avoid excessive yarn tension while the last third of the winding, even in the case of yarn remnants, is being unwound.

By cooperation of the scanner with the support face of the housing that carries the scanner, additional information on the exceeding of a certain winding thickness can be obtained in a simple manner: The scanner, which was previously tilted as it passed the beginning of the winding, loses its contact with the surface of the winding upon reaching the bottom cone of the bobbin and returns to its initial position. This is achieved by providing that the housing support face still rests on the large winding diameter and keeps the housing at the appropriate distance from the bobbin, while the scanner itself has already left this region of the winding.

The position of repose of the scanner inside the scanner housing, into which it can advantageously be brought by a tension spring, can be fixable by means of an adjustable stop. Adjustment of this stop may be considered, for example, if different yarn finenesses are being processed, or if bobbin differ from one another in their surface structure. It should be taken into account that the angular position of the scanner also affects its relative position with respect to the support face. Accordingly, it may protrude more or less far out of the vertical plane of the support face. Optimal adjustment is attainable with only slight experimentation. The manner in which the front edge of the scanner is structured is also important in this respect.

The three-dimensional disposition of the axis of rotation of the scanner with respect to the scanner plate itself makes it possible, by a steep positioning in the position of repose, to assure a sure grip on the yarn and at the same time to enable retracting the front edge of the scanner behind the support face, so that the winding will be handled gently. This effect can be reinforced still further by providing 90° offset support plates.

The advantageous embodiment of the travel measuring device permits very accurate detection of the position at a given time of the scanner housing and problem-free evaluation of the travel signals. Evaluating the sensor signal in association with the winding state of the tube can readily be done using the memory-programmable control that is already present anyway in a modern winding machine.

Figure 7:
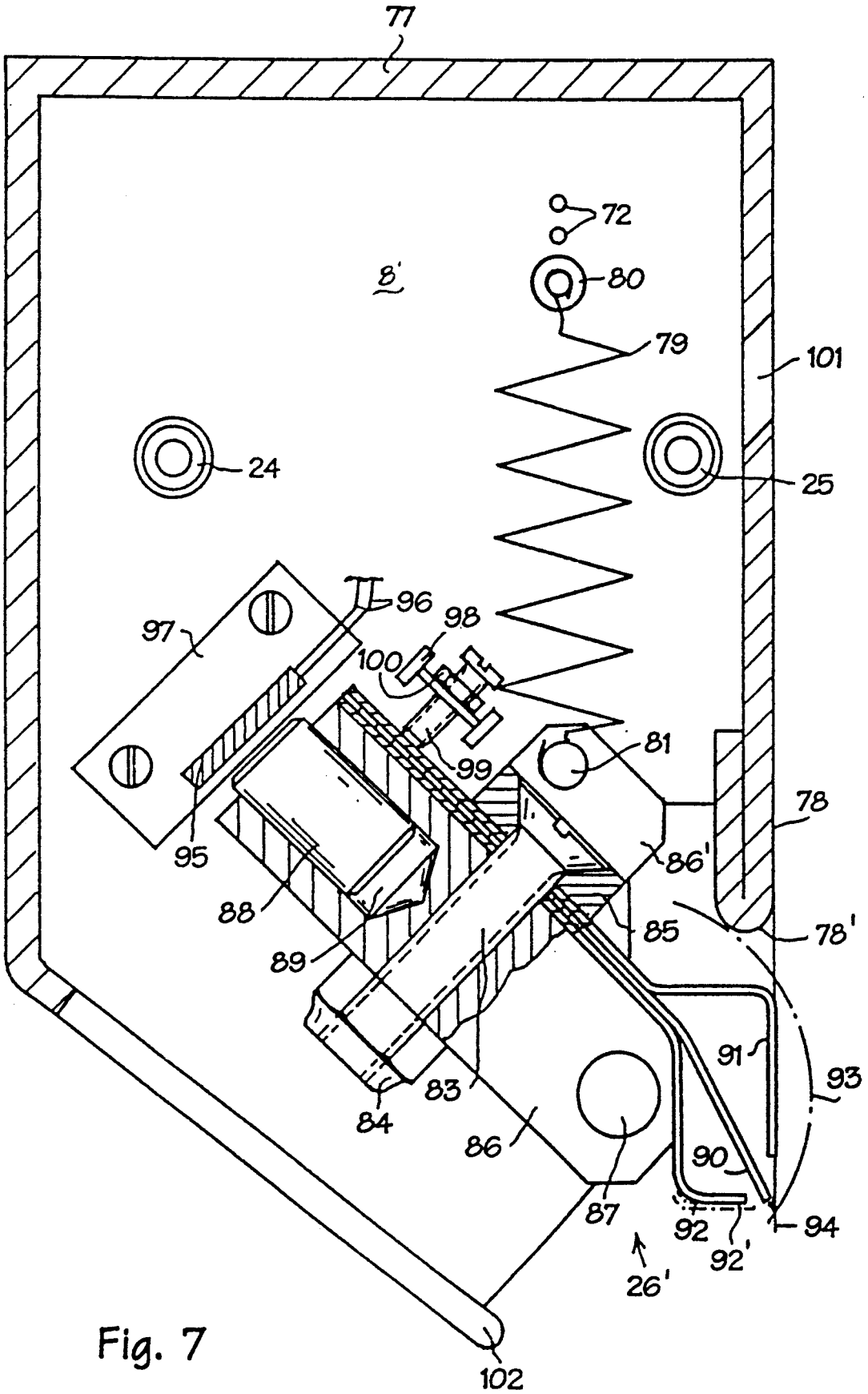
FIG. 7 is an enlarged side elevational view, in partial vertical section, of the detecting means of another embodiment of the classifying apparatus of the present invention, showing the detecting means in its first position.
Figure 8:
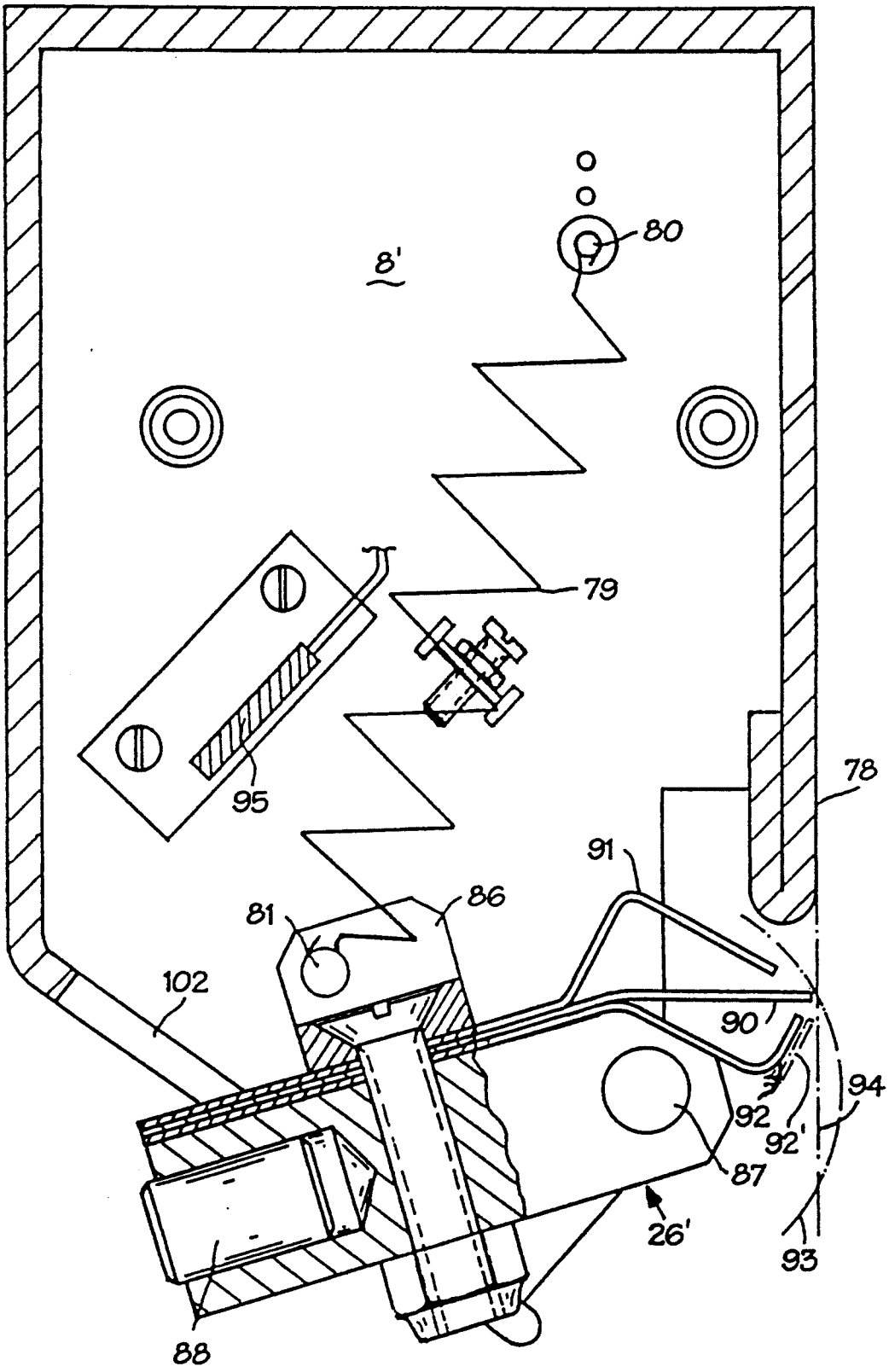
FIG. 8 is an enlarged side elevational view, in partial vertical section, of the detecting means shown in FIG. 7, showing the detecting means in its displaced position.

In FIGS. 7 and 8, another embodiment of the classifying apparatus of the present invention is illustrated. A compact mounting 86, which is rotatably supported on a shaft 87 secured within the housing 77, has a scanner plate 90, which to improve the detection of the beginning of the winding forms a steeper positioning angle and is therefore bent at an angle at its front end; the scanner plate 90 is surrounded by an upper 90° offset support plate 91 and a sheath plate extending adjacent the plate member for engaging yarn on the tube extending radially outwardly of the yarn engaged by the plate member, or a lower 90° offset support plate, 92. All three components are fastened to the mounting 86 by means of a screw 83 and a clamping element 85, with the aid of a nut 84. A spring fastener 81 is rotatably supported from a part 86' of the mounting 86 that is bent forward, in terms of the view in FIGS. 7 and 8, at an angle. This spring fastener 81, together with a further spring fastener 80, supports a restoring spring 79. To vary the spring force, the spring fastener 80 can be secured in various bores 72 of the housing 77.

The mounting 86 has a bore 89 into which a damping magnet 88 is inserted. This damping magnet may either be retained in the bore 89 by clamping force, or it is secured by additional locking means, not shown here, such as adhesive or screws. A proximity switch 95, which faces the damping magnet 88 in the position of repose of the scanner 26', is connected to the central control unit 41 in a manner not shown here via lines 96. The proximity switch 95 is disposed in a mounting 97, which is fastened to the housing 77. If necessary, this mounting 97 may be attached with a variable position in the housing 77. To that end, the fastening may be done by means of the screws shown in oblong slots on the back of the housing. This kind of positional adjustment of the mounting 97 with the proximity switch 95 may be necessary, for instance whenever the position of repose of the scanner 26' is adjusted.

The adjustment of the position of repose of the scanner 26' can be done by means of an adjusting screw 99, which is screwed into the bridge 98 joined to the back wall of the housing 77. A locknut 100 serves to fix the position of the check screw 99. To enable access to the check screw 99 by a screwdriver, a mounting opening 101 may be provided in the wall of the housing 77. The locknut 100 may for example be reached by providing that the front wall, not shown, of the housing 77 is removable. In any case, a passive change in position of the check screw 99 during operation of the scanner head 26' is hardly likely, and so the locknut 100 may optionally be dispensed with.

As can be seen particularly in combination with FIG. 8, the check screw 99 or bridge 98 must be disposed in a plane located behind the restoring spring 79. As already described, this is attained by bending the bent part 86' of the mounting 86 far enough forward and also by providing an adequate distance between the spring fastener 80 and the back wall of the housing 77. This can easily be done, for example by inserting a spacer piece, not shown, behind the spring fastener 80.

As can be seen from both drawing figures, the contact plane 94, which is located in the plane of the support face 78, is intersected twice by the path of motion 93 of the front edge of the scanner plate 90. As a result, as already explained in conjunction with the previous exemplary embodiment, the forwardmost point of this front edge of the scanner plate 90 is once again approximately in the middle of the path of motion 93, since the two intersection points between the contact plane 94 and the path of motion 93 simultaneously embody the two dead center points of the scanner motion. In the position shown in FIG. 8, which is equivalent to position II of FIG. 5, it can again be seen clearly that the front edge of the scanner plate 90 has moved backward behind the forwardmost position along the arc 90 far enough that it can easily deflect backward if there is any unevenness on the surface of the winding, without damaging the winding. To ensure that this motion occurs, a restoring spring that has precisely enough force for reliably retracting the scanner should be used.

The support plate 92, which is embodied as rounded and smooth, particularly on its outer edges, rests on the upper winding cone 4' when the scanner moves over that cone. To this end, the scanner 26' tilts upward somewhat past the position shown in FIG. 8. Then, the orientation of the front bent face of the support plate 92 corresponds approximately to the inclination of the tube cone. As a result, damage from the scanner is effectively prevented in this region as well.

As the dashed line for this front edge 92 shows, a corresponding lengthening of this support plate 92 is also possible, as a result of which there is no longer any contact between the front edge of the scanner plate 90 and the winding in the cylindrical part of the winding as well. The smooth outer face of the support plate has no negative influence upon the winding.

The upper support plate 91 is essentially provided in order that during a return stroke of the scanner head 8', once the scanner 26' has tilted back to its position of repose, the outer face of this support plate 91 will likewise protect the winding from the scanner plate 90.

In the embodiment of the housing , the lower edge of the support plate 78 was folded under, producing a rounded portion 78' that slides gently over the winding. On its lower end, the housing 77 has an opening 102 for the scanner 26' to pass through, which the scanner requires upon pivoting into the position shown in FIG. 8.

Although the two pivot joints 24 and 25 from which the scanner head 8' is suspended are shown directly joined to the housing 77 here as well, it may be advantageous to provide a mounting on which these pivot joints 24 and 25 are attached. The complete scanner head 8' can be inserted into this mounting by clamping or screwing means. Such an embodiment is especially advantageous if easy interchangeability of the complete scanner head is desirable.

Since the logic circuit in the central control unit, required for detecting the winding state, is based only on the travel signal and on a yes/no signal of the proximity sensor in order to identify two scanner positions, the memory-programmable control unit present in any case in an automatic winding machine can be used for this evaluation. This makes it possible at very little expense to obtain differentiated statements as to the winding state of tubes, in a way that was impossible, or could be done only at considerable effort and expense, in the prior art.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for use in classifying yarn package carrying tubes according to the amount of yarn, if any, thereon, comprising:

means for detecting the presence of yarn on a tube beyond a predetermined radial spacing from the axis of the tube;

means for axially moving the tube and the detecting means relative to one another during yarn detecting by the detecting means;

means for providing a signal in response to at least a selected one of the commencement, the cessation, and the absence of detection of yarn by the detecting means within a predetermined range of relative axial movement between the tube and the detecting means; and means for determining the axial location of the detecting means and the tube relative to one another.

2. An apparatus for use in classifying yarn carrying tubes according to claim 1 wherein the detecting means includes means for engaging yarn on the tube, the engaging means being movable between a first position out of yarn engagement and a displaced position displaced from the first position in response to the engaging means engaging yarn on the tube, and means for automatically returning the engaging means from its displaced position to its first position in response to movement of the engaging means out of engagement with yarn on the tube, and the signal means includes means for providing a signal in response to return movement of the engaging means from its displaced position to its first position.

3. An apparatus for use in classifying yarn carrying tubes according to claim 2 wherein each tube is of the type on which yarn is built in a body of yarn having an axial extent less than the axial extent of the tube such that at least one exposed end of the tube is not covered by the body of yarn and the means for axially moving the tube and the detecting means relative to one another includes means for axially displacing the detecting means from a start position at which the detecting means is positioned adjacent an exposed end of a tube to at least a signal location at which the means for providing a signal provides a signal and the determining means includes means for determining the extent of axial movement of the detecting means between the start position and the detecting position.

4. An apparatus for use in classifying yarn carrying tubes according to claim 3 and further comprising means for resiliently biasing the engaging means radially toward a tube to be detected, the resiliently biasing means permitting radially shifting the engaging means relative to a tube in response to changes in the radial extent of the yarn being engaged by the engaging means to thereby minimize the axial forces exerted on the yarn of a tube by the engaging means moving axially therealong.

5. An apparatus for use in classifying yarn carrying tubes according to claim 4 and further comprising a housing for pivotally mounting the engaging means for pivoting thereof between its first and displaced positions about a pivot axis transverse to the axis of a tube being detected.

6. An apparatus for use in classifying yarn carrying tubes according to claim 2 wherein the engaging means includes a serrated edge having apices, the engaging means being supported for raking movement along the yarn of a tube being detected.

7. An apparatus for use in classifying yarn carrying tubes according to claim 5 wherein the means for automatically returning the engaging means to its first position includes a spring normally compressed when the engaging means is in its first position and extended when the engaging means is in its displaced position.

8. An apparatus for use in classifying yarn carrying tubes according to claim 5 wherein the means for providing a signal includes a magnet mounted to the engaging means for movement therewith and means for generating a signal in response to the proximity of the magnet thereto within a predetermined distance range, whereby the magnet is displaced from a position proximate the signal generating means to a more remote position in correspondence with movement of the engaging means from its first to its displaced position and the signal generating means generates a signal in response to movement of the magnet into its more proximate position.

9. An apparatus for use in classifying yarn carrying tubes according to claim 2 and further comprising means for adjustably setting the first position of the engaging means.

10. An apparatus for use in classifying yarn carrying tubes according to claim 5 wherein the engaging means includes a plate member and a lever arm having one end pivotally mounted for pivoting about the pivot axis and another end mounted to the plate member for revolving movement of the plate member about the pivot axis, the means for resiliently biasing the engaging means includes a contact surface disposed for movement radially intermediate the pivot axis and the tube being detected and the radial location of the pivot axis is selected such that one end of the plate member, which extends radially inwardly of the contact surface for engaging yarn on the tube, extends radially inwardly to its greatest extent in the first position of the engaging means.

11. An apparatus for use in classifying yarn carrying tubes according to claim 5 wherein the engaging means includes a plate member and a lever arm having one end pivotally mounted for pivoting about the pivot axis and another end mounted to the plate member for revolving movement of the plate member about the pivot axis.

12. An apparatus for use in classifying yarn carrying tubes according to claim 10 wherein the portion of the means for resiliently biasing the engaging means which forms the contact surface terminates in the axial direction at a location axially spaced from the pivot axis for permitting unrestricted movement of the plate member radially inwardly and outwardly of the contact plate during pivoting of the plate member.

13. An apparatus for use in classifying yarn carrying tubes according to claim 10 wherein the one end of the plate member is disposed for engaging yarn on the tube terminates in a surface portion extending at a less acute angle to the axis of the tube than the adjacent surface portion for relatively smooth engagement of the yarn.

14. An apparatus for use in classifying yarn carrying tubes according to claim 10 wherein the engaging means includes a sheath plate extending adjacent the plate member for engaging yarn on the tube extending radially outwardly of the yarn engaged by the plate member to facilitate radially outward shifting of the engaging means during travel of the plate member along yarn of increasing radial extent.

15. An apparatus for use in classifying yarn carrying tubes according to claim 3 wherein the determining means includes an impulse counting device.

16. An apparatus for use in classifying yarn carrying tubes according to claim 3 wherein the means for axially displacing the detecting means includes a pair of rollers, an endless belt trained around the pair of rollers, and means for driving the endless belt, the detecting means being mounted to the endless belt for movement therewith.

17. An apparatus for use in classifying yarn carrying tubes according to claim 16 wherein the determining means includes means for counting the number of revolutions of one of the rollers and means for determining the extent of axial movement of the detecting means as a function of the number of revolutions of the one roller.

18. An apparatus for use in classifying yarn carrying tubes according to claim 16 and further comprising means for biasing the engaging means radially toward the tube and means for adjustably setting the radially inwardmost position of the engaging means.

19. An apparatus for use in classifying yarn carrying tubes according to claim 2 and further comprising means for aligning a tube to be detected in an alignment generally parallel to the path of movement of the detecting means.

* * * * *